United States Patent [19]

Ballinger et al.

[11] Patent Number: 4,868,538

[45] Date of Patent: Sep. 19, 1989

[54] RANDOM SIGNATURE ISLAND CIRCUIT

[75] Inventors: Forrest H. Ballinger, Grain Valley; Maurice H. Kohne, Blue Springs, both of Mo.

[73] Assignee: Harmon Industries, Inc., Blue Springs, Mo.

[21] Appl. No.: 254,971

[22] Filed: Oct. 7, 1988

[51] Int. Cl.[4] ..... B61L 29/00

[52] U.S. Cl. ..... 340/933; 246/125; 246/167 R; 246/34 A

[58] Field of Search ..... 340/47–49, 340/933; 246/125, 167 A, 34 R, 34 A, 128, 34 B, 122 R

[56] References Cited

U.S. PATENT DOCUMENTS

| | | | |
|---|---|---|---|
| 4,172,576 | 10/1979 | Suet, Jr. et al. | 246/125 |
| 4,324,376 | 4/1982 | Kuhn | 246/125 |
| 4,581,700 | 4/1986 | Farnham et al. | 340/941 |

*Primary Examiner*—Donnie L. Crosland
*Attorney, Agent, or Firm*—D. A. N. Chase

[57] ABSTRACT

An island circuit detects the presence of a train on a crossing island, and, in response, de-energizes a normally energized relay to activate a warning. A random signature signal is generated and transmitted through the rails from a transmitter to a receiver connected to the rails on either side of the island. If a train is present within the island, the wheels and axles form an electrical shunt, preventing the receiver from detecting the transmitted signal. The circuit employs solid state micro-electronic components and ancillary components, and embedded software for controlling and monitoring the circuit functions. The random signature signal is characterized by a relatively high voltage level but a low duty cycle on the order of ten percent, and has three variables: (1) frequency; (2) duration time of the pulse, or burst, of the signal; and (3) the delay between successive bursts. Each of the three variables randomly assumes any one of eight different discrete values. Each time a signal is received, the detector checks to determine whether the received signal matches the transmitted signature signal. If three consecutive transmitted and received signals do not match, the island warning device is activated, and then five consecutive matched signals are required to reset the system and cancel the island warning. This feature allows the island circuit to discriminate against signals from other island circuits or recover from a temporary malfunction, and return to normal operation.

19 Claims, 3 Drawing Sheets

RANDOM SIGNATURE ISLAND CIRCUIT

FIELD OF THE INVENTION

The present invention is directed to a method and apparatus for detecting the presence of a railroad train at an island formed by one or more railroad tracks crossing a street or roadway at grade level. More particularly, the present invention is directed to a microprocessor based electrical circuit for detecting the presence of a train and actuating a warning device if a train is present in the island or the apparatus fails.

THE PRIOR ART

Railroad tracks are frequently crossed at grade by paved roads, walkways, and the like for accommodating non-rail traffic. Non-rail traffic must be warned of railroad trains approaching such crossings, or present in the island, whether the train is moving or stationary.

Two separate detectors are typically employed at a crossing site. Conventionally, a motion detector is located adjacent to an island and continually measures an electrical property of the tracks, such as the impedance between the two rails of one set of tracks, notes the change in rail impedance caused by an approaching train, and activates a warning device, typically flashing red lights and an alarm bell, or crossing gates. Some motion detectors can also predict when the train will arrive at a crossing and actuate the warning device at a predetermined time before the train crosses the island, rather than when the motion of the train is detected. When these devices fail, they must also automatically activate the warning device. Motion detectors typically transmit a constant sinusoidal electrical signal in the audio frequency range from about 100 Hz to about 1,000 Hz with an amplitude of about 200 mv through both rails of a single track over a distance of from about 500 to about 3,000 feet on both sides of an island by means of a transmitter having its output connected to the rails on one side of the island. The signal is received by a receiver connected to each rail on the opposite side of the island. Such a motion detector is described in Farnham, et al, U.S. Pat. No. 4,581,700, issued Apr. 8, 1986, entitled "Processing System for Grade Crossing Warning." Such devices cannot, however, detect the presence of a stationary train. Because trains often stop at grade crossings, especially for example, in switch yards adjacent to industrial areas, a second detector is required.

The second detector is an island detector, which detects the presence of a train at an island whether the train is in motion or stationary. One prior art means for detecting a stationary train in an island was to apply a low voltage between the two rails of a track, so that one rail was electrically positive and the other negative or ground. Each end of each of the two rail sections lying across the island was electrically insulated from the rails lying outside the island, so that when a train came onto the electrically charged rails a short circuit was created, dropping the voltage between the rails and actuating a warning device. This prior art detector, however, required increased costs in building the railroad bed and increased costs in maintaining the insulation between adjoining rails outside the boundaries of the island. If the insulation failed, the now effectively lengthened rails themselves could cause a voltage drop that would trigger a false warning, and trains could likewise trigger warnings even when they were far from the island.

To overcome these and other difficulties with island detectors, the prior art teaches use of devices similar in principle to the motion detector discussed above, which devices transmit an overlay signal between a spaced transmitter and receiver set both connected to each rail of a set of tracks. A relatively strong signal is received by the receiver until a train crosses onto the island, when the train wheels and axle form a shunt across the tracks, dramatically reducing the signal strength to the receiver and triggering a warning device.

The overlay signal is typically transmitted at a level of about 200 mv. It is desired, however, that an increased signal voltage of about 3 volts be employed to enable the signal to overcome electrical resistance along the rails that may be present so that the detector will be more sensitive to the shunt formed by a train. However, increasing the voltage fifteen times would severely reduce battery life and unacceptably increase maintenance costs.

Other difficulties are also encountered when the detector employs a higher voltage. For example, this increased voltage also naturally transmits the signal over a greater distance and can cause interference with the motion detector's 200 mv, 100 Hz to 1,000 Hz signal, despite an increase in the signal frequency of the island detector to about 8,000 Hz. Furthermore, at sites having multiple sets of tracks and streets, the signals of motion detectors and island presence detectors can interfere with the detectors on nearby tracks or tracks having adjacent island crossings, causing false warnings which aggravate non-rail traffic conditions until repairs are made, a process which may take many hours. This mutual interference presents significant problems with frequency selection and modulation security. Accordingly, merely increasing the signal voltage is not acceptable because of reduced battery life and possible interference with other detectors.

Finally, to avoid mutual interference between units placed on adjacent sets of tracks or on adjacent crossing islands along the same set of tracks, a number of different models of detectors operating on different, preset frequencies are currently employed. Fourteen different frequencies in a range of from 2 KHz to 10,000 KHz are standard in the railroad industry, and many more are available through custom ordering. These units can operate on only one frequency, so the inventory of parts for detectors at every level of manufacture and distribution is necessarily large, as is the number of units a repairman must take into the field. In addition, detailed and accurate records of the signal frequency of each detector operating at a multiple track crossing, or in an area with adjacent crossing islands, must be maintained to reduce the chances of signal interference between detectors.

Therefore, a need exists for an island presence detector that will reliably detect the presence of a train consisting of one or more locomotives or other railroad cars, or the like, on an island formed by the grade intersection of a railroad and a non-rail street or path; that will detect the presence of a train on the island whether the train is in motion or stationary; that will not cause malfunction of the motion detector on the same set of tracks through signal interference; that will not be adversely affected by interference from the signal of the motion detector on the same set of tracks; that will not cause any malfunction of either motion detectors or island presence detectors on any other sets of tracks; that will not be adversely affected by interference from the signal of either motion detectors or island presence detectors on any other sets of tracks; that consists of a single electronic unit suitable for use at any island without modification or adjustment, thereby reducing manufacturing costs and inventory size, even at multiple track sites or adjacent islands; that does not consume excessive power; that is reliable; and that is economical to manufacture, install, and maintain.

SUMMARY OF THE INVENTION

Accordingly, it is an object of the present invention to provide an island presence detector that detects the presence of a train on an island whether the train is in motion or stationary.

It is another object of the present invention to provide an island presence detector that is separate from and independent of any motion detector.

It is another object of the present invention to provide an island presence detector that will not cause a malfunction of the motion detector on the same set of tracks or any other set of tracks.

It is another object of the present invention to provide an island presence detector that will not respond to any possible interference from the signal of the motion detector on the same set of tracks.

It is another object of the present invention to provide an island presence detector that will not respond to any possible interference from the signals of either motion detectors or island presence detectors on any other sets of tracks.

It is another object of the present invention to provide an island presence detector that consists of a single unit suitable for use at any island without modification or adjustment, even at multiple track sites or tracks having multiple crossing islands.

It is another object of the present invention to provide an island presence detector that does not consume excess electrical power.

It is another object of the present invention to provide an island presence detector that is economical to manufacture, install, and maintain.

These and other objects of the invention are achieved by providing an apparatus that detects the presence of a train on a crossing island, and, in response, de-energizes a normally energized electric relay, thereby activating the warning. The inventive island presence detector generates and transmits an electrical random signature signal through the rails of a set of railroad tracks from a transmitter to a receiver, with the transmitter and receiver being connected to the tracks on either side of the island. If a train is present within the island, the wheels and axles form an electrical shunt, preventing the receiver from detecting the transmitted signal.

More particularly, the present invention comprises electronic circuitry including solid state micro-electronic components and ancillary components, and embedded software for controlling and monitoring the circuit functions. The circuitry generates, and transmits to the rails, a signature signal that has three variables, which are (1) frequency; (2) duration time of the pulse, or burst, of the signal (measured in number of cycles of the burst in the preferred embodiment); and (3) the amount of time between each actual transmission of a burst signal, that is, time from the end of one burst signal to the beginning of the next burst signal (hereinafter "delay"). One entire signal cycle, that is from the beginning of one burst, through that burst, through the delay and to the beginning of the next burst, is referred to as the signature signal. The signature signal may also include a wait state, typically a brief constant period, between the end of one burst and the beginning of the delay. Each of the three variables in the signature signal randomly assumes any one of eight (8) different discrete values during any single signature signal. In addition, during certain reset conditions encountered during normal operation, the delay period between signal bursts is automatically shortened to enable the receiver to respond to another signature signal sooner. Therefore, the preferred embodiment disclosed herein can generate any one of a minimum of 512 possible signature signals at any time.

The specific discrete value of each variable is selected by a random signal generator in real time during operation of the system and changes immediately prior to the start of each signature signal. Thus, a random signature signal is generated, transmitted, and (in the absence of a train) a signal is received by the receiver which is located on the opposite side of the island. Then the detector checks to determine whether the received signal closely matches the transmitted signal, which is the signature signal. If three consecutive transmitted and received signals do not match, the island warning device is activated, and then five consecutive matched signals are required to reset the system and cancel the island warning. This feature allows the island presence detector to recover from some errors due to possible interference, poor transmission conditions, or temporary malfunction of the apparatus, and return to normal operation.

Although the invention employs a higher output voltage signal (about 3 volts) than commonly used prior art units, the low duty cycle of the signature signal (typically about ten percent) precludes interference with the motion detectors now in widespread use. The low duty cycle also minimizes drain on the trackside batteries.

The achievement of these and other objects of the invention will become apparent upon consideration of the detailed description of a preferred embodiment, taken in conjunction with the drawings.

DETAILED DESCRIPTION OF THE PREFERRED EMBODIMENT

This description generally will first discuss the signature signal that is transmitted and then received by the system, then the system hardware, and finally the software, along with the interrelationships between the hardware and software. Throughout the logic circuitry, a high voltage represents a binary one and a low voltage represents a binary zero, although negative logic could be employed if desired.

THE SIGNATURE SIGNAL

Figure 3:
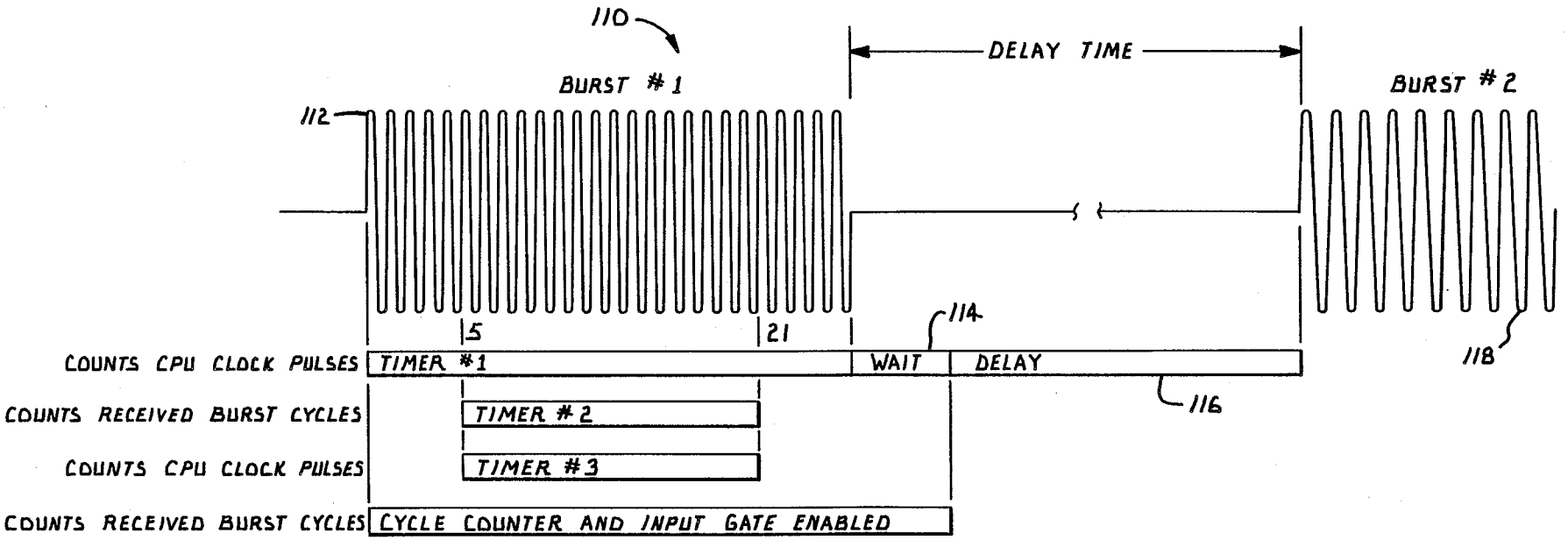
FIG. 3 illustrates a typical signal produced by the preferred embodiment of the present invention, shown in idealized form as seen at the input of the receiver portion of the apparatus, including the timing sequence of certain circuit functions.

Referring to FIG. 3, there is shown a typical signature signal produced by the island presence detector, in the form of a graph with time displayed on the horizontal axis and amplitude on the vertical axis. The signature signal, generally 110, sequentially consists of burst 112 of oscillating electrical waves; wait state 114 at the end of burst 112 during which no electrical signal is transmitted; and delay 116, during which no electrical signal is transmitted. Delay 116 follows the wait state, and precedes the next burst 118. The entire signal from the start of one burst to the start of the next burst is referred to as the signature signal because it is this entire cycle of burst, wait, delay, and start of the next burst that must be recognized by the hardware and software described below.

The variables in a signature signal are the frequency of the wave form in each burst; the duration of the burst, which is measured in number of cycles in a burst in the preferred embodiment; and the length of the delay between bursts. Specific values for each of these variables may naturally be selected by the designer as desired. In the preferred embodiment and best mode currently known to the inventors, as disclosed herein, those values are chosen from the following menus:

TABLE 1

| Frequency (Hz) | Cycles per burst | Delay (millisec) |
|---|---|---|
| 7,751 | 25 | 160 |
| 7,812 | 30 | 180 |
| 7,874 | 35 | 200 |
| 7,936 | 40 | 220 |
| 8,000 | 45 | 240 |
| 8,064 | 50 | 260 |
| 8,130 | 55 | 280 |
| 8,196 | 60 | 300 |

It must be emphasized that each of these three variables can assume any one of the eight predetermined values shown above to produce any one signature signal and that each value of each variable is selected randomly from among the values shown above for each new signature signal. Wait state 114 is an empirically determined constant 12 milliseconds in duration, and is included in the signature signal to ensure that possible ringout will not affect the detection scheme, as described below. Wait state 114 is controlled by the DO WAIT software routine, as described below. The signature signal as described requires only about a ten percent duty cycle, on average. Naturally, a larger or smaller number of values may be chosen and it is not necessary that the same number of values be available for each variable. Nor is it necessary to limit the variables in the signature signal to those fully disclosed herein. A pulsed signal suitable for use according to the present invention could employ such additional variables, for example, as signal amplitude, signal wave form, or a series of random signals, each comprising the selected variables which would be chosen randomly from predetermined menus.

THE ELECTRONIC HARDWARE

Figure 1:
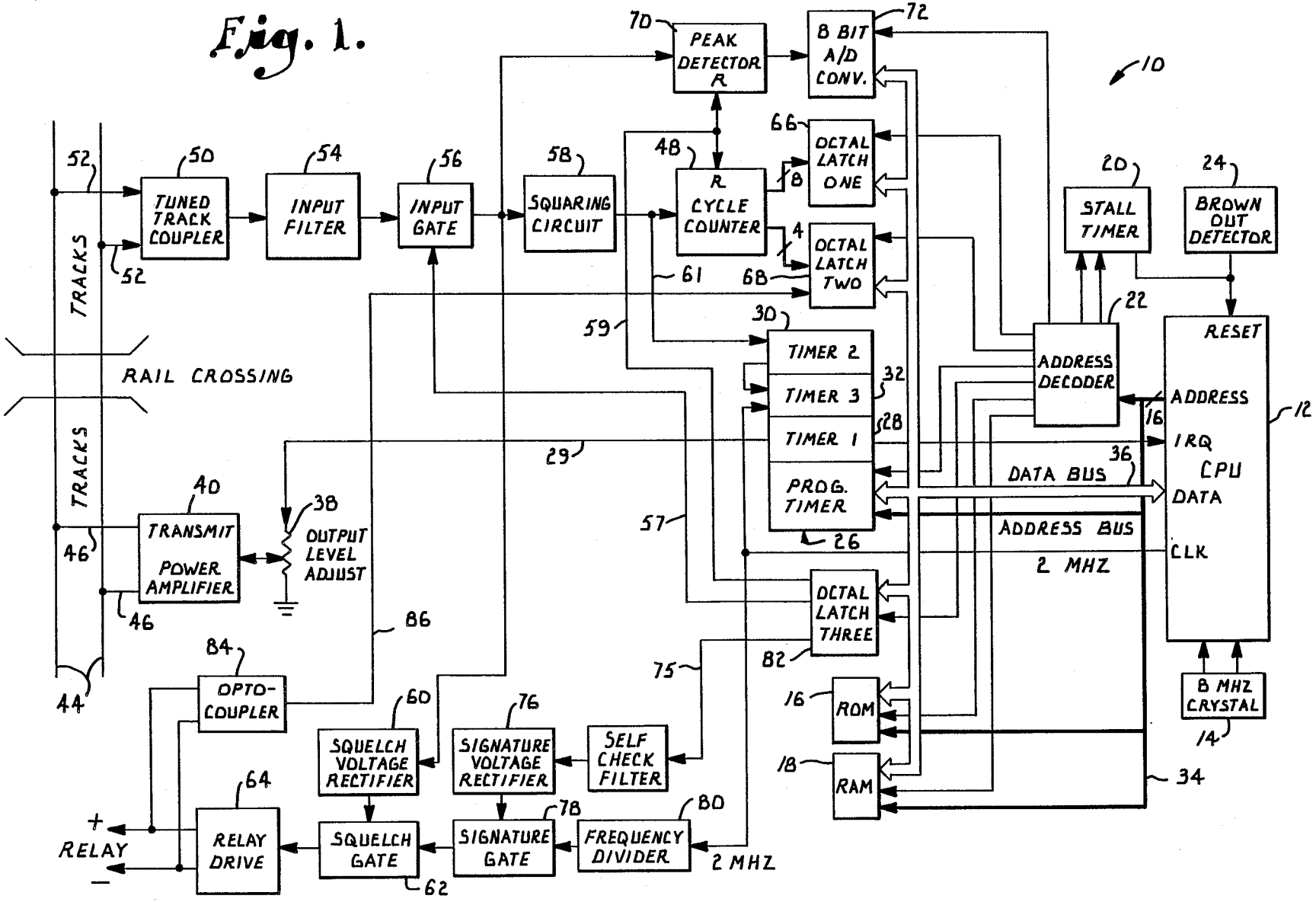
FIG. 1 is a block diagram schematic of the electronic hardware of a preferred embodiment of the present invention.

Referring to FIG. 1, illustrating the hardware, the discussion begins generally with the central processing unit, the timer/counter circuits, and the signal transmission circuits; then proceeds to the relay drive circuit, and finally to the receiver circuits.

In FIG. 1 the preferred embodiment of the island presence detector electronic hardware 10 includes central processing unit (CPU) 12 comprising an 8-bit microprocessor such as a Motorola 68B09 designed for use as a general purpose computing or control element in a system that includes stored computer programs, or software. CPU 12 includes all circuits required for fetching, interpreting, and executing instructions that are stored in memory, whether volatile or nonvolatile. Accordingly, the internal circuitry of CPU 12 comprises a program counter, an instruction decoder, an arithmetic logic unit, accumulators, and a crystal-controlled oscillator for generating clock pulses. An 8 MHz crystal 14 controls clock timing of all operations of the circuit, including CPU 12. The digital circuitry is clocked by 2 MHz clock pulses from output CLK generated by CPU 12 from the pulses produced by 8 MHz crystal 14.

Computer programs, or software, are stored in memory storage units. One suitable memory storage unit is read only memory (ROM) 16. ROM 16 is a non-volatile memory device that contains the software for operating CPU 12. Contents of ROM 16 are checked during operation of the island presence detector for proper checksum and proper cyclical redundancy check (CRC) value. If an error is found during either check, signature gate 78 disables relay drive 64, actuating the island crossing warning.

Random access memory (RAM) 18 is a conventional read/write memory that stores variable data for use by CPU 12. RAM 18 is tested non-destructively during operation to ensure that RAM 18 is operating properly. If an error is found, signature gate 78 disables relay drive 64, actuating the island crossing warning. Naturally, any type of read/write memory may be used.

Address decoder 22 generates all selects for all input/output (I/O) port, timer, memory, and stall timer circuit elements.

Stall timer 20 enhances the reliability of the island presence detector by resetting CPU 12 if the software stalls out due to any type of failure. Stall timer 20, connected to CPU 12, is a stable multivibrator that must periodically receive a binary logic one on its input from address decoder 22 to maintain its output at a binary one. Under normal operation, address decoder 22, under software command, sends a periodic high pulse to an input of stall timer 20, maintaining the output of stall timer 20 at a high level, and thereby preventing stall timer 20 from resetting CPU 12. If address decoder 22 fails to reset stall timer 20, then stall timer 20 runs free, resetting CPU 12, and reinitializing operation of the apparatus. If the software still fails to execute properly, address decoder 22 will not send a binary one to stall timer 20 and stall timer 20 will continue to run free, preventing the software from executing, and actuating the island crossing warning, until the software does execute properly.

Brown-out detector 24, also a reliability device, monitors the power supply line (not shown) for voltage sag. If the power supply voltage drops below the minimum operating voltage of the circuitry, typically about four volts in the preferred embodiment, brown-out detector 24 will hold CPU 12 in a constant reset state, preventing operation of the island presence detector and actuating the island warning during too low voltage conditions, which could cause undefined, inaccurate, and spurious operation of the island presence detector. When the power supply voltage rises above the minimum operating voltage, brown-out detector 24 releases CPU 12 from reset, enabling the island presence detector to operate normally.

Programmable timer 26, which is a Motorola 68B40 in the best mode currently known to the inventors, contains three timer/counters, which are timer/counter one 28, timer/counter two 30, and timer/counter three 32 that are all controlled by signals from CPU 12 transmitted through address bus 34 and data bus 36. Each timer/counter is a down counter, which in operation is loaded with a predetermined count, and then counts down to binary zero, or empty, to trigger further operations. During a transmit cycle, timer/counter one 28 generates a burst signal comprising an essentially square wave form at a discrete constant frequency randomly selected from the eight frequencies listed in Table 1. The burst signal is applied to potentiometer 38 via line 29, which is adjusted so that the final output signal level transmitted by transmitter power amplifier 40 is about three volts. The signal is transmitted via a tuned track coupler (not shown separately), which is an integral component of transmitter power amplifier 40, and feeder leads 46 to rails 44.

Timer/counter one 28 generates the burst portion of the signature signal, acting on software commands from CPU 12. After transmitting a burst, timer/counter one 28 measures the delay between bursts, as measured in CPU 2 MHz clock pulses. Timer/counter three 32 determines whether the transmitted signal and the received signal have the same frequency, through indirect means, as discussed below. At the start of a signal burst, timer/counter one 28 begins counting the number of cycles in the burst to allow only the predetermined number of cycles in a burst to be transmitted, the duration of the burst having been chosen through use of the RANDOM software routine (discussed below) from among the eight possible durations listed in Table 1. Also at the start of a burst, cycle counter 48 is enabled via input gate 56, allowing cycle counter 48 to count each cycle of the signal received by the receiving circuit (shown in generally the upper left hand portion of FIG. 1; see also FIG. 3). During proper operation, and in the absence of a train in the island, the received signal should match the transmitted signature signal, allowing for some time lag in reception due to impedance presented by the track and the receiver circuits, ringout, and the usual minor distortions found in electrical circuits generally.

It should be understood that when timer/counter one 28 counts to zero, it sends an interrupt service request to the interrupt request input (IRQ) of the CPU 12, where the interrupt service software routine causes a stoppage in execution of the main program loop and causes timer/counter one 28 to be reloaded with the next count and to resume counting down. After timer/counter one 28 is reloaded and restarted, the interrupt service routine returns execution of the program to the point in the loop where it was interrupted.

When timer/counter one 28 begins generating a burst, CPU 12 commands octal latch three 82 to enable input gate 56 of the receiver circuit, and releases the reset signal on the input of cycle counter 48 via line 59, allowing cycle counter 48 to count cycles of the received signal. When a burst ends, CPU 12 commands octal latch three 82 to disable input gate 56 and reset cycle counter 48 (preventing it from counting any further signals). These two operational features accomplish two important functions. First, the receiver circuit is automatically disabled during the delay, and enabled only when the next burst is transmitted. This is readily accomplished in the island presence detector because a single CPU controls all transmitter and receiver circuits (which are in the same package). Accordingly, the random variable "delay" chosen for use by the transmitter circuits is automatically checked by the receiving circuit. If, for example, a signal is received by the receiver during a delay, it will not be processed by the receiver, reducing any possible problems of outside signal interference during the delay portion of the signature signal. If that signal is the transmitter signal, however, it will similarly not be processed by the receiver during the expected delay, but being out of synchronization with the receiver, will not be processed when the receiver expects a burst signal either. The island presence detector will assume the presence of a train on the island, and activate the island crossing warning. Thus, the timing and length of the delay portion of the signature signal must both notch in order for the receiver to process the transmitted burst signal. If the island presence detector recognizes a match between the transmitted and received signals, then another signature signal is selected and transmitted, received and recognized, and so forth until the unit fails or detects a train on the island. This continual cycle of matching transmitted and received signals prevents actuation of the island crossing warning. Second, the possibility of interference from other signal sources is dramatically reduced since the receiver circuits are disabled except when the transmitter sends a burst signal.

The operating environment of the island presence detector may cause some initial distortion of the received signature signal while a later portion of the signal tends to match the transmitted signal more closely. To increase the likelihood of working with an undistorted signal, cycle counter 48 counts an empirically predetermined number of cycles (five in the preferred embodiment) prior to enablement of timer/counter two 30, which then begins counting received cycles from squaring circuit 58 via line 61 and simultaneously enables timer/counter three 32, which counts 2 MHz clock pulses. When timer/counter two 30 has counted sixteen cycles of the received signal, timer/counter two 30 stops timer/counter three 32. The number then stored in timer/counter three 32 is then compared to a previously calculated number stored in ROM 16 that corresponds to the transmitted frequency to determine if the received burst signal is the correct signal, that is, has the same frequency. This requires, in the preferred embodiment, calculating the number of 2 MHz clock cycles that occur during sixteen cycles of each of the eight possible burst signal frequencies listed in Table 1 and storing the results in ROM 16 (see STRTCNT2, discussed below).

Referring generally to the receiver portion of the circuit shown in FIG. 1, tuned track coupler 50 connected to rails 44 by leads 52 has a low input impedance at the center of the transmitter's signal frequency band (about 7,950 Hz; see Table 1) and high impedance outside the transmitter's signal frequency band. Use of this passband filter in tuned track coupler 50 helps prevent loading of other electronic equipment that may be connected to rails 44, as well as adding some signal filtering to the receiver input. The received signal is conducted from tuned track coupler 50 to input filter 54 of the receiver circuit.

Input filter 54 includes a passband filter (not shown separately), having a passband wide enough to pass all frequencies that can be transmitted by the island presence detector, and a stopband attenuation sufficient to prevent outband signals from interfering with recognition of the signature signal. From input filter 54, the signal is conducted to input gate 56 which is enabled via line 57 from octal latch three 82 only when the CPU 12 expects to receive a signal burst transmitted by the transmitter circuit, further reducing the possibility of interference from extraneous signals. When input gate 56 is enabled, the received signal is fed to cycle counter 48 via squaring circuit 58, which is a zero cross detector with a sufficiently high gain to clip the received signal and thereby restore the signal to a square wave (−20 db threshold). Squaring circuit 58 also has hysteresis characteristics that force its output to a zero logic state whenever its input voltage is below a predetermined minimum level.

When enabled, input gate 56 also passes the received signal to squelch voltage rectifier 60, having a −30 db threshold, which converts the received signal to a negative control voltage that drives squelch gate 62. Thus, gate 62 is open in response to a received signal from input gate 56 of sufficient amplitude, and passes a 250 KHz signal if present from signature gate 78, to be discussed below. Because the signal from input gate 56 consists of short burst signals separated by relatively long delays during which no signal is transmitted, the attack time of the squelch control (comprising squelch voltage rectifier 60 and squelch gate 62) is fast and the decay time is slow, in order to prevent squelch gate 62 from closing and activating the island crossing warning during the normal delay portion of a signature signal. The squelch control disables relay drive 64 and activates the island crossing warning when there is a failure to receive a sufficiently strong received signal, which can be due to the presence of a train (shunt) on the island, or a failure of the island presence detector itself.

When enabled, input gate 56 also passes the signal to timer/counter two 30, via squaring circuit 58. Cycle counter 48 then counts all the cycles of the received signal burst coming out of squaring circuit 58. To ensure that cycle counter 48 begins each counting routine with a zero count, cycle counter 48 is reset by CPU 12 via line 59 from octal latch three 82 before input gate 56 is enabled by CPU 12. Cycle counter 48 is a conventional 12-bit counter and its output is read by CPU 12 via octal latch one 66 and octal latch two 68 after input gate 56 is disabled. The count accumulated by cycle counter 48 while input gate 56 is enabled is the total number of cycles of the received signal. CPU 12, under software command, compares this cycle count with the number of cycles transmitted in the burst. If the number of transmitted cycles is not the same as the number of received cycles, CPU 12 disables relay drive 64 via octal latch three 82, thereby activating the island crossing warning.

Peak detector 70 is, in effect, a software squelch gate that, through CPU 12 and related software, disables relay drive 64 (activating the island crossing warning) if the peak received signal strength for any burst signal is less than a predetermined minimum value, about −18 db in the preferred embodiment. The peak detector 70 is slightly less sensitive than squelch gate 62. Detector 70 measures the highest amplitude of each signal burst that passes through input gate 56 and holds a direct current voltage signal that is related to that highest amplitude cycle, such DC signal being applied to 8-bit A/D converter 72 which converts the DC output of peak detector 70 to a corresponding 8-bit number that is then read by CPU 12 after input gate 56 is disabled. Using this amplitude information, CPU 12 controls the self-check output signal on line 75 from octal latch three 82 to self-check filter 74, to thereby control the operational threshold of the island presence detector.

Turning now to the relay driver circuit, relay drive 64 is a DC to DC converter that is driven by the 250 KHz signal derived from the 2 MHz clock signal from CPU 12 via frequency divider 80 (divide by eight). If the 250 KHz signal is not input into relay drive 64, the DC to DC converter will not operate, permitting the relay to drop out and thereby activate the island warning. The related circuit elements, that is, self-check filter 74, signature voltage rectifier 76, signature gate 78, squelch voltage rectifier 60, and squelch gate 62, all provide various checks to ensure that the island presence detector is operating properly. These elements must be enabled in order for the 250 KHz signal from frequency divider 80 to be received by relay drive 64, as is discussed above and in detail immediately below. As a further precaution against improper operation, the relay drive voltage is both transformer coupled and capacitively coupled to the rectifiers (not shown), so that the island presence detector power supply cannot energize the output relay.

Self-check filter 74 is a high Q-factor filter that passes only the correct self-check output on line 75 from CPU 12. The frequency of the self-check signal is determined by the main program loop repetition time. The resulting signal is passed via octal latch three 82 to self-check filter 74. When the program does not execute in the proper loop time, the frequency of the self-check signal will change enough so that the signal will not pass through self-check filter 74. Then there will be no output from self-check filter 74, and the island crossing warning will be actuated.

Signature voltage rectifier 76 produces a negative control voltage that drives signature gate 78. Accordingly, if self-check filter 74 has no output, signature gate 78 is disabled via signature voltage rectifier 76, activating the island crossing warning.

Opto-coupler 84 is responsive to the output voltage of relay drive 64, detecting the presence of the relay drive voltage that indicates the absence of a train. Opto-coupler 84 comprises a light-emitting diode (LED) that is energized by the presence of a voltage in the relay drive output, and a phototransistor (components not shown individually). The excited LED produces light, exciting the phototransistor which, in turn, maintains line 86 at a predetermined binary logic level. Through operation of opto-coupler 84, line 86 is pulled to a binary logic zero when no relay drive signal is present from relay drive 64, and is pulled to a binary logic one when relay drive is present. The binary logic level on line 86 is read by CPU 12 via octal latch two 68 when a signature signal is not recognized by the receiver. This condition, that is, relay drive present (and no island warning given), and a received signal strong enough not to trigger either squelch gate 62 or peak detector 70 circuitry, and that does not match the transmitted signal, indicates a failure of some type in the island presence detector, and further indicates an urgent need to determine if the receiver has simply misread a signature signal or if a train is present. Accordingly, this condition causes CPU 12 to reduce the delay between bursts, thereby reducing recognition time and desynchronizing the successive signature signals from the signature signals of other island detectors, eliminating possible interference between detectors and providing the island presence detector an opportunity to receive and recognize signature signals more quickly. The elimination of the delay portion of the signature signal is accomplished by forcing the program routine to interrupt its execution and return to RANDOM routine. This function is also discussed in more detail hereinafter in the description of the LOSCOUNT software routine.

THE SOFTWARE

Figure 2:
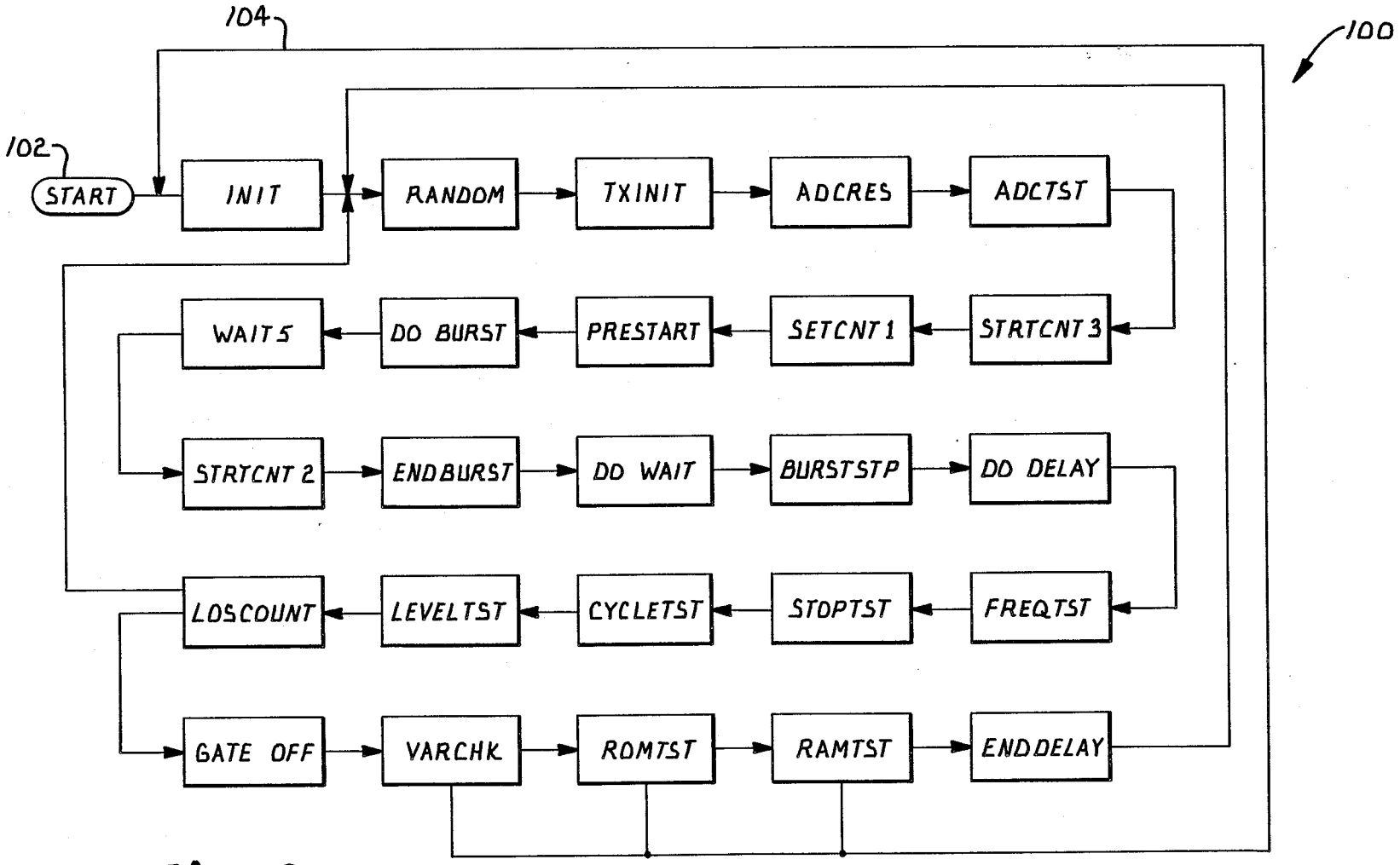
FIG. 2 is a block diagram flow chart of the computer software of a preferred embodiment of the present invention, designed for use with the hardware of FIG. 1.

Referring to FIG. 2, there is shown a block diagram flow chart generally 100 of the software that directs the island presence detector hardware described above. All the software is embedded in ROM 16, which contains the program for CPU 12. The complete program, comprising the routines described below, is cyclical and executes a main loop in less time than the total signature time (signal burst time plus delay time). Start 102 indicates the beginning point for execution of the program, with feedback loop 104 representing the cyclical nature of the program. The software routines will be discussed in the order in which they appear in FIG. 2. Since this order is easily followed, reference numbers will not be used. The program comprises the following routines.

INIT (initialization) routine. This routine is entered when either (1) power is turned on; (2) the unit is manually reset; or (3) an error occurs. INIT initializes the internal registers in the CPU for proper subroutine calling; initializes certain selected RAM locations with proper data; and initializes the programmable timer. This routine also tests the CPU registers and RAM for proper functioning, and tests the ROM program via CRC and checksum comparisons, by comparing the true and digital complement values for important circuit parameters and function variables. Checksum and CRC tests are also periodically conducted while the programs are running and the island presence detector is operating.

RANDOM (random number generator) routine. The random number generator produces a 24-bit random number, which is stored as three separate 8-bit binary numbers in RAM 18. The three least significant binary digits from each of the three 8-bit random numbers are used to determine which of the eight possible values will be used as the frequency value for the signature signal (see TXINIT routine, discussed below), the number of cycles in the signature signal, and the duration of the delay time between bursts, respectively. The then current 24-bit random number is used as the seed number for generating the next 24-bit random number. Since computer routines called random number generators do not generate truly random numbers, it may be thought that different units of the present invention might produce like random numbers, and hence, like signature signals, which could interfere with one another. This is not the case, however, because the numbers generated by RANDOM are somewhat a function of the elapsed time from the last CPU reset, which of course will never be the same between different units of the invention.

TXINIT (transmitter initialization) routine. The transmitter initialization routine uses the three stored 8-bit random numbers to select the value for the signal burst frequency, the duration of the burst and the delay between bursts.

ADCRES (A/D converter and cycle counter reset) routine. This routine resets the A/D converter and cycle counter.

ADCTST (A/D converter and cycle counter test) routine. This routine tests the A/D converter and the cycle counter to verify that they have been reset by the ADCRES routine.

STRTCNT3 (start timer/counter three) routine. This routine initializes the count value of timer/counter three and starts it counting. Timer/counter three counts the number of CPU 2 MHz clock pulses that occur during sixteen cycles of the received input burst.

SETCNT1 (set timer/counter one) routine. This routine initializes the count value of timer/counter one 28. Timer/counter one 28 controls the frequency of the transmitted signal burst. The count value in timer/counter one is the number of CPU 2 MHz clock cycles that occur during one-half of one cycle of the burst frequency. When timer/counter one is done, it interrupts the CPU, causing the CPU to restart timer/counter one, which then counts the number of 2 MHz clock pulses occurring during one-half of one cycle of the burst frequency again. When the predetermined number of cycles of the burst has been transmitted by the transmitter circuitry to the rails, the output of timer/counter one is disabled and timer/counter one then counts the 2 MHz clock pulses that occur during the delay.

PRESTART routine. This routine enables the A/D converter, the cycle counter, and the receiver input gate to prepare these circuit elements to receive the transmitted signal burst.

DO BURST routine. This routine starts timer/counter one, thereby starting the signal burst.

WAIT5 (wait for five burst cycles) routine. This routine waits for five received cycles of the burst signal. The value in cycle counter 48 is monitored until five cycles of the burst signal have been counted. This is an empirically determined wait state designed to avoid problems with distorted signals.

STRTCNT2 (start timer/counter two) routine. This routine starts timer/counter two 30, which outputs an enable signal to timer/counter three 32. Timer/counter two 30 counts sixteen cycles of the receiver input burst. When timer/counter two 30 has counted sixteen cycles of the received signal, it disables timer/counter three 32. The value stored in timer/counter three 32 at this time is the digital complement of the number of CPU 2 MHz clock cycles that occurred during sixteen cycles of the receiver input signal burst.

ENDBURST routine. This routine monitors timer/counter one 28 to determine when the burst has been completed.

DO WAIT routine. This routine reinitializing the interrupt service routine counter with a fixed duration delay count (12 milliseconds in the preferred embodiment, see WAIT in FIG. 3), disables timer/counter one output, and restarts timer/counter one. The received input burst signal must end prior to completion of this delay or else the CPU considers the burst to be continuous and in error.

BURSTSTP (burst stop) routine. This routine monitors the receiver input signal by means of cycle counter 48 to determine whether the burst has stopped. This routine runs until timer/counter one 28 completes the delay started by the DO WAIT routine.

DO DELAY routine. This routine reinitializes the interrupt service routine of the CPU with the value for the delay between bursts, disables the output of timer/-counter one 28, and restarts timer/counter one 28.

FREQTST (frequency test) routine: This routine compares the digital complement of the value stored in timer/counter three 32 after timer/counter two has counted sixteen cycles of the received signal with the value used in transmitting the burst (see SETCNT1 above with reference to timer/counter one) to determine if the frequency that was received is the same as the frequency that was transmitted in the signal burst.

STOPTST (stop test) routine. This routine determines if the burst stopped within the wait delay period after the transmitter stopped transmitting. (See DO WAIT and BURSTSTP routines.)

CYCLETST (number of cycles received test) routine. This routine determines whether the number of received cycles is within the acceptable window for the number of cycles transmitted, that is, whether the number of received cycles is within about 1.25 times the number of cycles transmitted. This wider window is necessary because the Q-factor of receiver input filter 54 delays arrival of the received signal. The Q-factor of input filter 54 can also cause some ringout, which can add phantom cycles to the count.

LEVELTST (level, or amplitude, of received signal test) routine. This routine compares the amplitude, from 8-bit A/D converter 72, of the received burst signal to the predetermined threshold level. If the received signal is below the threshold, indicating the probable presence of a train (shunt) the output of relay drive 64 is disabled, and the island crossing warning is activated as discussed above.

LOSCOUNT (lost burst signal counter) routine. The purpose of this routine is to disable relay drive 64, activating the island warning, if the received signature signal does not match the transmitted signature signal. The island detector operates in a harsh environment that includes extremes of heat and cold, of wind and rain, of vigorous vibration. This harsh operating environment, coupled with possible interference from other detectors, possible difficulties responding to the shunt formed by a train, and possible temporary errors in the execution of instructions by the circuitry of the apparatus (all discussed above), increase the small likelihood that a received signature may not match a properly transmitted signature when a train is not present. Activating the island crossing warning every time a single transmitted and received signature do not match would result in an unacceptably large number of false island warnings. LOSCOUNT is designed to permit a certain number of mismatches to be read prior to activating the island warning. If three consecutive mismatched transmitted and received signatures are detected, LOSCOUNT disables relay drive 64, activating the island warning. When five consecutive matched transmitted and received signatures are counted, LOSCOUNT enables relay drive 64, cancelling the island warning.

When a transmitted and received signature mismatch is detected, and relay drive voltage is present (that is, the island crossing warning is not activated), as determined by opto-coupler 84, the software program returns immediately to the starting point of the loop program, that is, to RANDOM, and does not complete the delay time that normally follows the burst 112 and wait state 114 (see FIG. 3). Restarting the software routines with RANDOM causes a reset in the random number generator, initiating a newly random string of signatures, and preventing any possible synchronous operation of two units according to the present invention that might otherwise interfere with one another. When a signature mismatch is detected, and relay drive voltage is absent (island warning activated), the presence of a train (the shunt) is extremely likely, so the software program advances to the GATE OFF routine which prevents a received signal from being processed (see GATE OFF below). This will not jeopardize traffic on the island crossing because the island crossing warning is activated.

GATE OFF routine. This routine disables receiver input gate 56 to prevent interference from extraneous signal sources when the CPU is not expecting a received burst signal because none has been transmitted.

VARCHK (variable check) routine. This routine checks the true and digital complement values of the critical variables to determine if they contain the proper values. A disagreement between the true and complement values is considered a fatal error. All fatal errors cause the CPU to reset.

ROMTST (read only memory test) routine. This routine does CRC and checksum tests on the program data to determine if the program has changed, which should not happen. A mismatch between the calculated values and the stored values is a fatal error.

RAMTST (random access memory test) routine. This routine performs a nondestructive memory test on all locations in RAM. A malfunctioning RAM location is likewise a fatal error.

ENDDELAY (end of signal burst transmission test) routine. This routine monitors the interrupt service routine counter to determine when the delay between bursts has been completed.

Having thus described the invention, what is claimed as new and desired to be secured by Letters Patent is:

1. A method of operating an island presence detector in order to activate a warning device when a train is present on a railroad track at an island crossing, comprising the steps of:

(a) generating a pulsating electrical signal having a characteristic electrical signature;

(b) transmitting said pulsating electrical signal to the rails at a transmission point on one side of the crossing;

(c) receiving said pulsating electrical signal on said rails if it is present at a reception point on the other side of the crossing; and (d) comparing said transmitted signal with a received signal at said reception point to determine if they both have said characteristic electrical signature, and if said signals match, maintaining the warning device deactivated, and if said signals do not match or said received signal has an amplitude below a predetermined threshold, activating said warning device.

2. The method as claimed in claim 1, wherein said step (a) comprises generating a signal burst of a frequency randomly chosen from a first plurality of predetermined possibilities, providing a duration of said signal burst randomly chosen from a second plurality of predetermined possibilities, and providing a delay between signal bursts randomly chosen from a third plurality of predetermined possibilities, whereby to impart said characteristic electrical signature to said pulsating electrical signal.

3. The method as claimed in claim 2, wherein said step (a) further comprises changing the choice of first, second and third possibilities each time a burst is generated.

4. The method as claimed in claim 2, further comprising the step of reducing said delay between signal bursts if said warning device is deactivated and the received signal has an amplitude above said threshold and does not match the transmitted signal.

5. The method as claimed in claim 2, wherein said step (a) further comprises providing a constant predetermined wait period between the end of each signal burst and the beginning of the ensuing delay.

6. The method as claimed in claim 2, wherein said step (d) comprises determining if said transmitted and received signals are of the same frequency contemporaneously, and determining if the contemporaneous signal bursts of said transmitted and received signals are of the same duration.

7. The method as claimed in claim 6, further comprising the step of precluding said determinations of the frequency and duration of the transmitted and received signal bursts during at least a portion of said delay between signal bursts.

8. The method as claimed in claim 2, wherein said step (d) comprises the steps of:

(1) determining if said transmitted and received signals are of the same frequency by deriving a number indicative of the time period during which a predetermined number of cycles of the signal burst of the received signal occurs, and comparing said number with a number corresponding to the frequency of the contemporaneous signal burst of the transmitted signal; and (2) determining if the contemporaneous signal bursts of said transmitted and received signals are of the same duration by counting the cycles of the signal burst of the received signal and comparing the cycle count with the number of cycles in the contemporaneous signal burst of the transmitted signal.

9. The method as claimed in claim 1, wherein said step (a) of generating said pulsating electrical signal comprises the steps of:

(1) generating a random number;

(2) storing three separate portions of said random number in a memory;

(3) using one of said stored random number portions to choose a burst signal frequency from a predetermined menu of frequencies;

(4) using a second of said stored random number portions to choose a burst signal duration from a predetermined menu of durations;

(5) using a third of said stored random number portions to choose a time delay from a predetermined menu of delays; and (6) successively providing said pulsating electrical signal with a burst signal of chosen frequency and duration followed by a chosen delay prior to the next burst signal to thereby provide said characteristic electrical signature.

10. The method as claimed in claim 9, wherein said step (d) comprises determining if said transmitted and received signals are of the same frequency contemporaneously, and determining if the contemporaneous signal bursts of said transmitted and received signals are of the same duration.

11. The method as claimed in claim 10, further comprising the step of precluding said determinations of the frequency and duration of the transmitted and received signal bursts during at least a portion of said delay between signal bursts.

12. The method as claimed in claim 9, wherein said step (d) comprises the steps of:

(1) determining if said transmitted and received signals are of the same frequency by deriving a number indicative of the time period during which a predetermined number of cycles of the signal burst of the received signal occurs, and comparing said number with a number corresponding to the frequency of the contemporaneous signal burst of the transmitted signal; and (2) determining if the contemporaneous signal bursts of said transmitted and received signals are of the same duration by counting the cycles of the signal burst of the received signal and comparing the cycle count with the number of cycles in the contemporaneous signal burst of the transmitted signal.

13. An island presence detector for activating a warning device when a train is present on a railroad track at an island crossing, said detector comprising:

means for generating a pulsating electrical signal having a characteristic electrical signature;

means for connecting said generating means with the rails of the track at a transmission point on one side of the crossing to deliver said pulsating signal to the rails;

a receiver responsive to said pulsating signal and adapted for connection with said rails at a reception point on the other side of the crossing for receiving signals transmitted along the rails;

processing means connected with said generating means and said receiver for comparing said transmitted signal with a received signal to determine if they both have said characteristic electrical signature; and warning control means adapted for connection to said warning device and responsive to said processing means for maintaining the warning device deactivated if said transmitted and received signals have matching signatures, and activating said warning device if said transmitted and received signals do not have matching signatures or the received signal has an amplitude below a predetermined threshold.

14. The detector as claimed in claim 13, wherein said generating means includes means for generating successive signal bursts, each of a frequency randomly chosen from a first plurality of predetermined possibilities, means for providing a duration for each signal burst randomly chosen from a second plurality of predetermined possibilities, and means for providing a delay between signal bursts randomly chosen from a third plurality of predetermined possibilities, whereby to impart said characteristic electrical signature to said pulsating electrical signal.

15. The detector as claimed in claim 14, wherein said generating means further includes means changing the choice of said first, second and third possibilities each time a burst is generated.

16. The detector as claimed in claim 14, further comprising means operably coupled with said generating means for reducing said delay between signal bursts if the warning device is deactivated and the received signal has an amplitude above said predetermined threshold and its signature does not match the signature of the transmitted signal.

17. The detector as claimed in claim 14, wherein said processing means includes means for determining if said transmitted and received signals are of the same frequency contemporaneously, and means for determining if the contemporaneous signal bursts of said transmitted and received signals are of the same duration.

18. The detector as claimed in claim 17, wherein said receiver includes gating means preventing reception of incoming signals during at least a portion of said delay between signal bursts, whereby to preclude said determinations of the frequency and duration of the transmitted and received signal bursts during said portion.

19. The detector as claimed in claim 14, wherein said processing means includes means for deriving a number indicative of the time period during which a predetermined number of cycles of the signal burst of the received signal occurs, and means for comparing said number with a number corresponding to the frequency of the contemporaneous signal burst of the transmitted signal, whereby to determine if the transmitted and received signals are of the same frequency, and wherein said processing means further includes means for counting the cycles of the signal burst of the received signal and comparing the cycle count with the number of cycles in the contemporaneous signal burst of the transmitted signal, whereby to determine if the contemporaneous signal bursts of the transmitted and received signals are of the same duration.

* * * * *